United States Patent [19]

Gajer et al.

[11] 3,946,870

[45] Mar. 30, 1976

[54] COLLAPSE-RESISTANT PAPERBOX PACKAGING

[75] Inventors: Israel Gajer, Levittown; Theodore Licht, St. James, both of N.Y.; Harold Goodman, Lexington, Mass.

[73] Assignee: Jameco Industries, Inc., Wyandanch, N.Y.

[22] Filed: Feb. 6, 1975

[21] Appl. No.: 547,699

[52] U.S. Cl. ..... 206/471; 206/45.31; 206/372; 206/497; 229/9

[51] Int. Cl.[2] B65D 5/38; B65D 13/08; B65D 65/02; B65D 73/00

[58] Field of Search..... 206/45.14, 45.15, 45.19, 206/45.31, 45.33, 45.34, 334, 372, 466, 468, 471, 495, 497, 521; 229/9–11, 19–20, 41 R, 41 B

[56] References Cited

UNITED STATES PATENTS

| | | | |
|---|---|---|---|
| 2,755,982 | 7/1956 | Vanderluej, Jr. | 206/334 X |
| 3,385,424 | 5/1968 | Thompson et al. | 206/497 X |
| 3,741,387 | 6/1973 | Whitecar | 229/9 X |
| 3,752,301 | 8/1973 | Bluemel | 206/521 |
| 3,767,037 | 10/1973 | Anderson | 206/45.19 |

*Primary Examiner*—William Price
*Assistant Examiner*—Steven E. Lipman
*Attorney, Agent, or Firm*—Stoll and Stoll

[57] ABSTRACT

Collapse-resistant paperbox packaging for small articles, comprising an outer paperbox shell and an inner corrugated paperboard sleeve removably encased within said paperbox shell, said corrugated paperboard sleeve having a transparent plastic skin laminated thereto with an article secured between them, and said corrugated paperboard sleeve having upwardly extending flanges which juxtapose side panels in the paperbox shell. The corrugated paperboard sleeve reinforces the paperbox shell and combines with it to provide a strong box construction highly resistant to collapsing. A window is provided in the paperbox shell so that the article may be exposed to view through said window and through the transparent plastic skin.

4 Claims, 6 Drawing Figures

COLLAPSE-RESISTANT PAPERBOX PACKAGING

BACKGROUND OF INVENTION

1. Field of Invention

This invention relates to the packaging of small articles for display and sale in self-service stores.

2. Prior Art

There are three basic prior art packaging arrangements which are pertinent to the present invention:

1. A package consisting of a flat sheet of paperboard (or equivalent) and a transparent plastic skin laminated thereto over an article supported thereon. This package provides no real protection for the article against damage resulting from crushing or rough handling, especially if the article is heavy, but it does protect against damage from moisture, dust and other conditions, and it does expose the article to the view of customers.

2. A package comprising an outer shell and an inner sleeve removably carried thereby. In this type of packaging the emphasis is on protecting the article carried therein, but it lacks the protection of a plastic skin which immobilizes the article and protects it from damage by moisture, dust and other conditions. Moreover, the article is not exposed to the view of customers.

3. A package comprising an outer shell — generally a paperbox — with a window and a transparent plastic sheet or film extending across the window. This is a structurally weak package with little protection for the article contained therein against crushing, rough handling and like conditions.

SUMMARY OF THE INVENTION

This invention combines the advantages of all three forms of packaging last above described, and adds features of its own. It comprises an outer shell which has a generally weak structure, usually a paperbox, and an inner removable sleeve which has an essentially strong structure, but only when combined with the outer shell. The inner sleeve has a corrugated paperboard base with upturned flanges. This base provides the paperbox outer shell with structural strength in one plane and the upturned flanges provide it with structural strength in a plane normal to the first mentioned plane.

The article carried by the corrugated paperboard base is protected by said base, by the flanges which are upturned therefrom, and by the transparent plastic skin which is laminated to said corrugated paperboard base. It is also protected by the paperbox outer shell which is now strengthened by the corrugated paperboard inner sleeve. The article is exposed to the view of customers through a window formed in the paperbox outer shell and through the transparent plastic skin.

DESCRIPTION OF PREFERRED EMBODIMENT OF INVENTION

Figure 1:
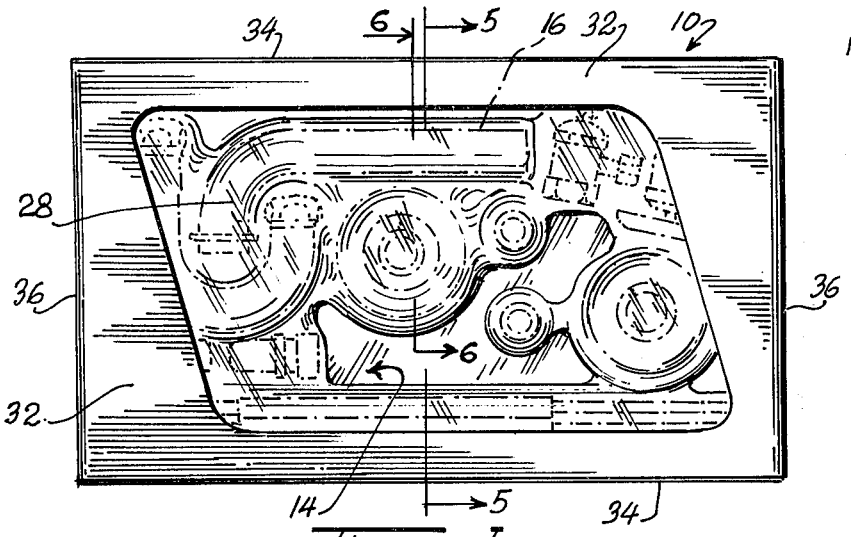
FIG. 1 is a top view of a collapse-resistant paperbox package made in accordance with this invention.
Figure 2:
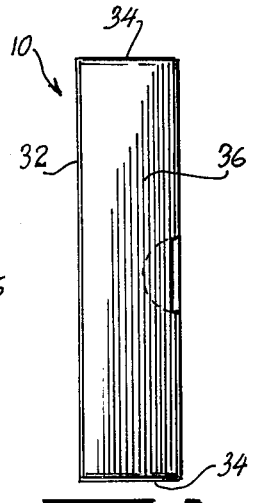
FIG. 2 is an end view thereof.
Figure 3:
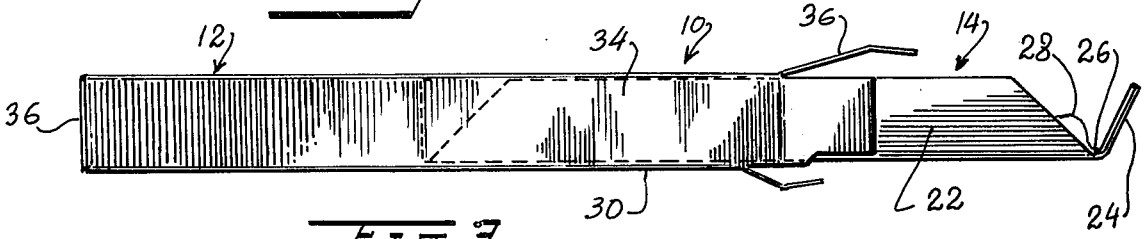
FIG. 3 is a side view showing the inner sleeve extending partly into and partly out of the shell.
Figure 4:
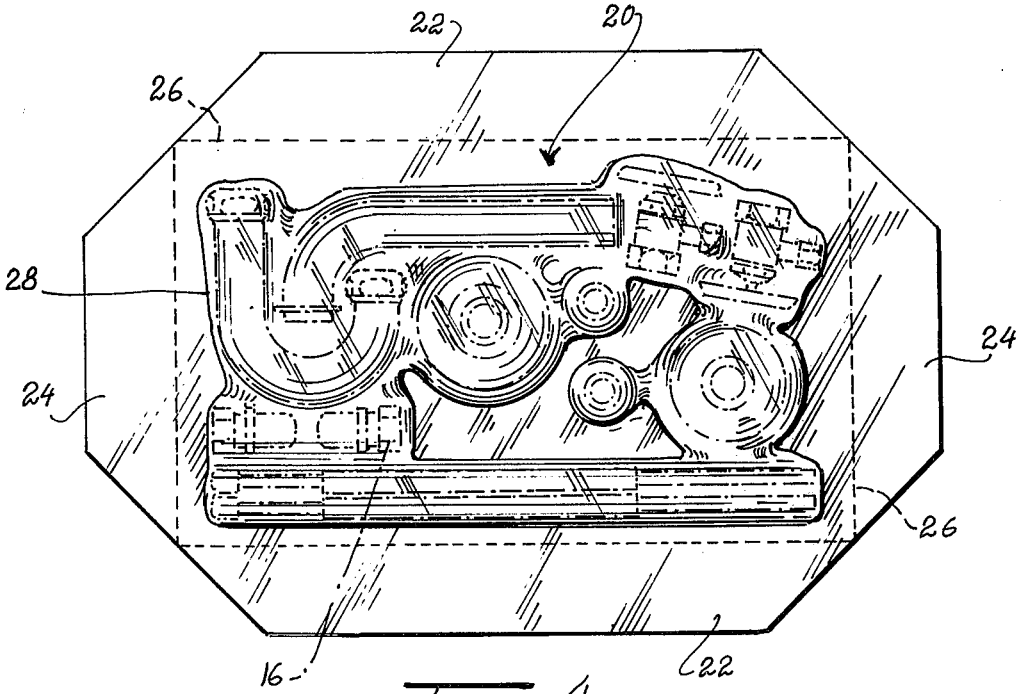
FIG. 4 is a plan view of the inner sleeve shown spread flat.
Figure 5:
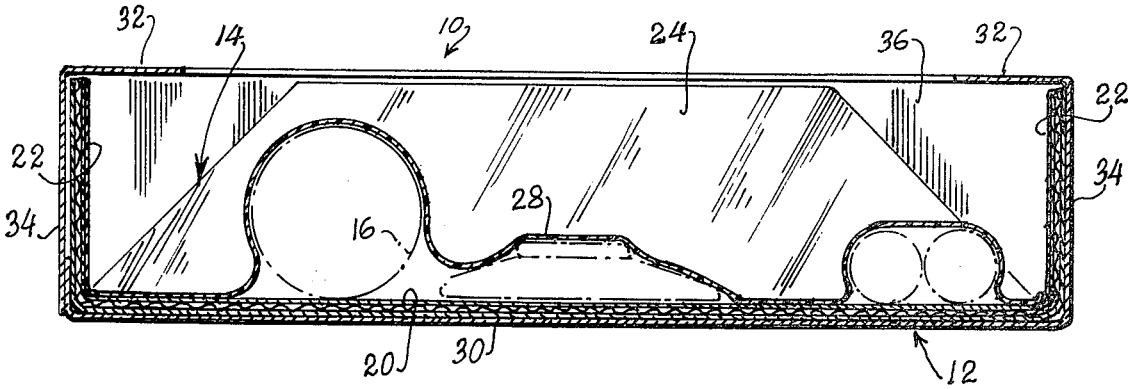
FIG. 5 is an enlarged cross-section taken on the line 5—5 of FIG. 1.
Figure 6:
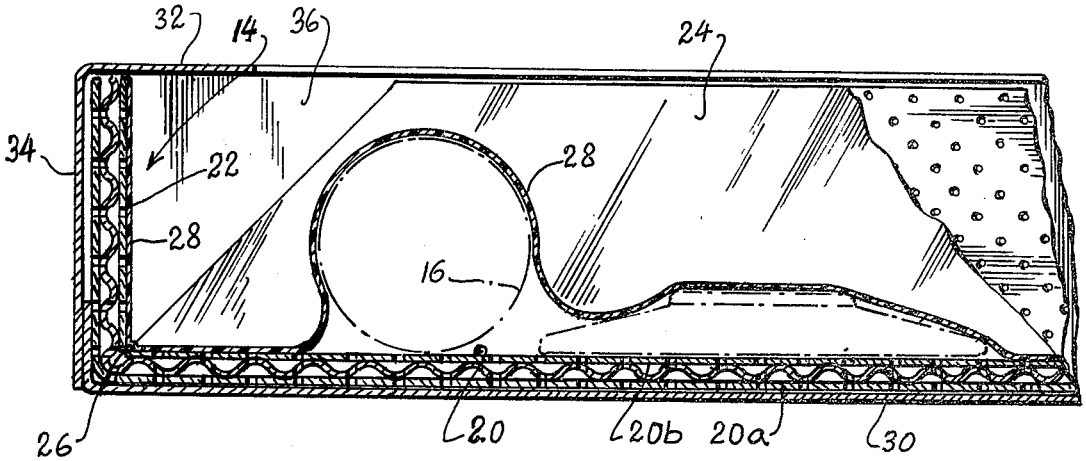
FIG. 6 is a greatly enlarged fragmentary section taken on the line 6—6 of FIG. 1.

Collapse-resistant paperbox structure 10 shown in the drawing comprises an outer shell 12 and an inner sleeve 14 removably supported within said outer shell. The inner sleeve carries an article 16 which is protected by both said inner sleeve and said outer shell, and is exposed to the view of customers through both the inner sleeve and the outer shell. As indicated, article 16 may be any product (or plurality of products) normally pre-packaged at the factory for display and sale to ultimate consumers. Illustrative of such products are plumbing parts and supplies, e.g., replacement parts for kitchen sinks, hardware items such as door knobs and locks, tools and accessories such as portable electric drills and drill bits, and various other products in other fields and categories.

The inner sleeve comprises a generally rectangular corrugated paperboard base 20 having a pair of side flanges 22 extending upwardly from its sides and a pair of end flanges 24 extending upwardly from its ends. These side and end flanges are integral with the base and are die-cut from the same corrugated paperboard sheet. Score lines 26 separate said side and end flanges from the base and enable them to be bent upwardly from the base to form the sides and ends of the sleeve. It should be understood that under certain conditions (e.g., in packaging light-weight articles) the use of the two side flanges, alone, or the two end flanges alone (as distinguished from the use of all four flanges) will suffice for the purposes of the invention. The use of two flanges instead of four will produce a strong package, but not as strong as a package utilizing four flanges.

It will be seen that, in the preferred form of this invention, the corrugated paperboard base (with its side and end flanges) is formed from a sheet of single-face corrugated paper **20*a* laminated to a sheet of non-corrugated paper 20*b* which may be printed for decorative or functional purposes or both. Paper sheet 20*b* may be plastic-coated for adhesion with transparent plastic skin 28. As is conventional in the use of such plastic skin, the corrugated paperboard base and, preferably, its side and end flanges, are perforated for the vacuum forming process whereby the plastic skin is drawn over the article (or articles) 16 and laminated to paper sheet 20*b*. As will be noted, score lines 26 are die-cut only into said paper sheet 20*b*** so that the side and end flanges may be bent upwardly from the corrugated paperboard base while remaining joined thereto. If need be, the corners of the flanges may be trimmed as shown in the drawing.

It will be seen that the article (or articles) 16 is protected by the corrugated paperboard base as well as by its side and end flanges which extend at least as high as the article itself, and it is also protected by the plastic skin. Since the plastic skin is transparent, the article (or articles) will be exposed to the view of customers.

Turning now to the outer shell 12, it will be seen that it may comprise a conventional generally rectangular window-type paperbox having a bottom wall 30, a top wall 32, a pair of side panels 34 and a pair of end flaps 36. These end flaps serve as closures for the paperbox and may be opened to insert or remove the inner sleeve or closed to confine the inner sleeve in said paperbox. It will be observed that an opening 38 is diecut into the top wall of the paperbox and it will be understood that this opening constitutes a window through which the article carried by the inner sleeve may be viewed.

When the inner sleeve is slipped into the paperbox, the side flanges of the inner sleeve juxtapose the side panels of the paperbox and the end flanges of the inner sleeve juxtapose the end flaps of the paperbox. The corrugated paperboard base and its side and end flanges provide structural strength along their respective planes and cooperate with the bottom and top walls and side panels and end flaps of the paperbox to provide a relatively strong, collapse-resistant enclosure for the article or articles contained therein.

The foregoing is illustrative of a preferred form of the present invention and it will be understood that design modifications may be incorporated therein to meet individual packaging requirements, without departing from the essential principles of the invention as defined in the appended claims. Also, different materials may be used in the construction of the several component parts of the invention, for example, du Pont de Nemours' ionomer resins which are sold under the trademark Surlyn, plasticized polyvinyl chloride shrink films, polyethylene-acetate laminates and polycarbonate films may be used to form the plastic skin component.

We claim:

1. Collapse-resistant paperbox packaging for small articles, such as plumbing parts and accessories, hardware, tools and other pre-packaged products, said collapse-resistant paperbox packaging comprising:

a. an outer shell and an inner sleeve removably encased in said outer shell, b. said inner sleeve consisting of a generally rectangular corrugated paperboard base having a pair of side flanges extending upwardly therefrom and a transparent plastic skin securing at least one article to said corrugated paperboard base, between said side flanges, c. said outer shell consisting of a generally rectangular paperbox having top and bottom walls joined by a pair of side panels, d. said inner sleeve being disposed within said outer shell between said top and bottom walls and between said side panels of the paperbox juxtaposed, e. whereby said inner sleeve reinforces the outer shell and resists collapse of said outer shell under conditions of normal use and abuse, f. said corrugated paperboard base being provided with a pair of end flanges, in addition to its side flanges, and g. said paperbox being provided with a pair of end flaps, in addition to its side panels, h. said end flanges and said end flaps being juxtaposed to further reinforce the outer shell and resist its collapse.

2. Collapse-resistant paperbox packaging in accordance with claim 1, wherein:

a. the end flaps of the paperbox function as closures therefor, b. said end flaps being adapted to be opened and closed to open and close the paperbox, c. said inner sleeve being slidably supported in said paperbox for slidable removal therefrom when one of the end flaps is opened.

3. Collapse-resistant paperbox packaging in accordance with claim 1, wherein:

a. the corrugated paperboard base with its side and end flanges comprises a laminated structure consisting of:

b. a single face corrugated paper sheet, its single face directed downwardly from said base and outwardly from said flanges, its corrugated flutes directed upwardly from said base and inwardly from said flanges, and c. a sheet of paper adhesively laminated to said corrugated flutes and providing a second face on said corrugated paper sheet, d. said laminated structure being perforated for a vacuum forming operation performed on the transparent plastic skin, e. whereby the transparent plastic skin is laminated to the corrugated paperboard base, over the article supported thereon, to secure said article to said base.

4. Collapse-resistant paperbox packaging in accordance with claim 1, wherein:

a. the top wall of the paperbox has a window formed therein in substantial registration with the placement of the article which is secured to the corrugated paperboard base, b. whereby said article is exposed to view through said window and the transparent plastic skin which secures said article to said corrugated paperboard base.

* * * * *